United States Patent [19]

Sookne

[11] Patent Number: 4,486,485

[45] Date of Patent: Dec. 4, 1984

[54] NONWOVEN TEXTILE STRUCTURES WITH REVERSIBLE STRETCH

[75] Inventor: Arnold M. Sookne, Greensboro, N.C.

[73] Assignee: Burlington Industries, Inc., Greensboro, N.C.

[21] Appl. No.: 526,144

[22] Filed: Aug. 24, 1983

[51] Int. Cl.[3] ..... B32B 27/14

[52] U.S. Cl. ..... 428/198; 156/272.2; 156/290; 428/195; 428/288

[58] Field of Search ..... 428/360, 359, 362, 369, 428/370, 288, 296, 297, 299, 195, 198, 303; 156/272.2, 290

[56] References Cited

U.S. PATENT DOCUMENTS

| | | | |
|---|---|---|---|
| 2,385,870 | 10/1945 | Lashar et al. . | |
| 2,753,286 | 7/1956 | Buchkremer et al. . | |
| 2,978,785 | 4/1961 | Wenzell, Jr. . | |
| 3,081,513 | 3/1963 | Marek . | |
| 3,117,055 | 1/1964 | Guandique et al. | 428/360 |
| 3,329,556 | 7/1967 | McFalls et al. | 428/360 |
| 3,368,934 | 2/1968 | Vosburgh, Sr. . | |
| 3,451,887 | 6/1969 | Touey et al. . | |
| 3,458,387 | 7/1969 | Suskind et al. | 428/362 |
| 3,639,154 | 2/1972 | Sawa et al. . | |
| 3,671,379 | 6/1972 | Evans et al. | 428/362 |
| 3,723,238 | 3/1973 | Werner et al. . | |
| 3,837,338 | 9/1974 | Chesky et al. . | |
| 4,038,452 | 7/1977 | Kobayashi et al. . | |
| 4,118,531 | 10/1978 | Hauser . | |
| 4,129,675 | 12/1978 | Scott . | |
| 4,209,563 | 6/1980 | Sisson | 428/288 |
| 4,256,524 | 3/1981 | Hare | 428/360 |
| 4,296,163 | 10/1981 | Emi et al. | 428/296 |
| 4,426,420 | 1/1984 | Lkhyani | 428/288 |
| 4,429,002 | 1/1984 | Fukado et al. | 428/288 |

*Primary Examiner*—James J. Bell

*Attorney, Agent, or Firm*—Cushman, Darby and Cushman

[57] ABSTRACT

A nonwoven textile structure which exhibits improved stretch/recovery characteristics comprises a blend of staple fibers having a first component of crimped nonelastic fibers and a second component of quasi-elastic fibers, the crimped and quasi-elastic fibers being bonded together at predetermined intervals less than the staple fiber length and greater than the crimp length.

14 Claims, No Drawings

NONWOVEN TEXTILE STRUCTURES WITH REVERSIBLE STRETCH

The present invention relates generally to nonwoven textile structures having improved stretch/recovery characteristics. More particularly, the present invention relates to nonwoven fabrics made from staple fiber blends of highly crimped nonelastic fibers and substantially straight quasi-elastic fibers bonded together at intervals less than the staple length of the crimped fibers but greater than the length of their individual crimps.

A basic deficiency of nonwoven fabrics is their lack of reversible elasticity, i.e. lack of stretch/recovery characteristics. When subjected to a deforming strain, conventional nonwoven fabrics, typically made from fibers such as polyethylene terephthalate, exhibit little or no recovery, thereby leading to bagging, wrinkling and non-reversible distortions in general. Thus, conventional nonwoven fabrics are unsuited as face fabrics for garments. Additionally, conventional nonwoven fabrics do not exhibit the pleasing textile-like hand which garment producers normally require.

Those in the art have continually sought improved means for increasing the stretch/recovery characteristics of nonwoven textile structures. For example, in U.S. Pat. No. 3,639,154 to Sawa et al, fibrous structures of, for example, crimped yarns are treated with an aqueous polysiloxane emulsion to improve their extension/-recovery characteristics. The reader may also wish to refer to the following U.S. patents for further background information with respect to the present invention: U.S. Pat. Nos. 4,118,531 to Hauser; 4,129,675 to Scott; 3,368,934 to Vosburg, Sr.; 3,723,238 to Werner et al; 2,385,870 to Lashar et al; 3,081,513 to Merek et al; 3,837,338 to Chesky et al; 4,038,452 to Kobayashi et al; 2,978,785 to Wenzell, Jr., et al; 2,753,286 to Buchremer et al; and 3,451,887 to Touey.

The present invention overcomes certain of the defects typically associated with conventional nonwoven fabrics. For example, nonwoven fabric structures in accordance with the present invention more closely resemble conventional woven textile fabrics in addition to exhibiting improved extension/recovery characteristics. Accordingly, the present invention is believed to fulfill a distinct need in the art.

As briefly noted above, the nonwoven structures of the present invention comprise a blend of highly crimped non-elastic stable fibers and substantially straight or uncrimped quasi-elastic staple fibers. The term "non-elastic fiber" as used herein is meant to include all fibers which in their straight form have little or no elasticity, but at the same time have either a high level of natural crimp or the capacity for taking a high crimp. Suitable fibers include nylons 6 and 66, polypropylene, and especially polyethylene terephthalate. The term "quasi-elastic fiber" as used herein refers to fibers intermediate in elastic modulus between truly elastomeric fibers such as spandex and natural or synthetic rubbers on the one hand, and the non-elastic fibers described above on the other. Quasi-elastic fibers broadly include such fibers as, for example, modacrylics such as Monsanto Company's SEF modacrylic fiber, fibers made from polymers and copolymers of polymethylene terephthalates containing three to six methylene groups, and all other fibers exhibiting lower tensile modulus and higher tensile form recovery than the average non-elastic fiber. The polymethylene terephthalates include polytrimethylene terephthalate, polytetramethylene terephthalate, polypentamethylene terephthalate and polyhexamethylene terephthalate polymers, as well as their copolymers which contain lesser amounts, i.e., less than about 30 mole percent, of other glycols of dibasic acids, such as ethylene glycol or isophthalic acid. Most preferred is polytetramethylene terephthalate, best known commercially as polybutylene terephthalate. Each of the specific examples of the quasi-elastic fibers noted above exhibits lower tensile modulus and higher tensile form recovery as specified herein.

The above-noted nonelastic and quasi-elastic staple fibers can be blended according to conventional carding techniques well known to those in the art. Additionally, one or more members of each type of fiber (i.e., nonelastic and quasi-elastic) can be blended to achieve nonwoven products having a variety of stretch/recovery properties. It is preferable that the percentage of quasi-elastic fibers based on the total composition of the nonwoven product be at least about 30%.

The staple fibers can have a variety of lengths typically on the order of about 1 inch to about $1\frac{7}{8}$ inches and particularly about $1\frac{1}{2}$ inches. Any staple fiber length can be advantageously utilized in accordance with the present invention so long as it is greater than the crimp length of the nonelastic fibers. Normally, the staple fiber length will be at least ten times the crimp length.

Crimping of the nonelastic staple fibers can be accomplished by any technique well known to those in this art, for example, stuffer box crimping, gear crimping and like texturing means. The staple nonelastic fibers used in accordance with the present invention should be highly crimped, on the order of at least 10 crimps per inch, and preferably between about 10 to 20 crimps per inch, for example. However, crimping frequencies less than 10 crimps per inch and greater than 20 crimps per inch are also contemplated by this invention, the crimp frequency being dictated in large part by the desired characteristics of the finished nonwoven product.

Bonding the nonelastic and quasi-elastic fibers together at predetermined selected intervals is an important aspect of the present invention. It is theorized that initial extension stress upon a nonwoven fabric in accordance with the present invention primarily affects the substantially straight quasi-elastic fibers, causing them to stretch from their relaxed state. Meanwhile, due to the bonding of the crimped nonelastic fibers to the straight quasi-elastic fibers, the crimps of the former are removed to an extent dependent upon the magnitude of the stress, up to the point where the crimped nonelastic fibers are fully extended (i.e. substantially straight and uncrimped). When the extension stress is removed, the quasi-elastic fibers return to their relaxed state, thereby permitting the nonelastic fibers to return to their relaxed crimped state.

In order to ensure adequate extension and recovery of the nonwoven fabric in accordance with the present invention, bonding of the crimped nonelastic fibers and the quasi-elastic fibers should occur at intervals less than the staple fiber length and greater than the crimp length of the nonelastic fibers. Typically, staple fiber lengths can be between about 1 inch to about $1\frac{7}{8}$ inches, more typically about $1\frac{1}{2}$ inches. The crimp length of the nonelastic fibers is, of course, the inverse of the crimp frequency. For example, staple nonelastic fibers having a crimp frequency of 10 crimps per inch (i.e. corresponding crimp length $=0.10$ inch) should be bonded to the staple quasi-elastic fibers at intervals greater than 0.10 inch but less than the staple length of the nonelastic fibers. Should it be desirable to blend fibers of varying staple lengths, the upper extent of the bonding interval would be dictated by the shortest staple length comprising the blend.

There presently exist several known techniques which can be advantageously utilized to bond the nonwoven textile structure of the present invention. For example, bonds can be imparted to a nonwoven batt by utilizing conventional heated embossed rolls. Alternatively, powdered thermoplastic adhesives can be applied to the batt at selected locations so that, upon curing, the adhesives effect the desired bonding. Additionally, the nonwoven structure can be bonded by utilizing conventional ultrasonic bonding devices, particularly where the nonwoven structure of the present invention is comprised of nonelastic and quasi-elastic fibers where both are capable of ultrasonic fusion, but also where only one or the other is subjected to fusion. A typical ultrasonic bonding device is disclosed in, for example, U.S. Pat. No. 4,311,540 (the entire disclosure of which is incorporated hereinto by reference).

As is true of many types of nonwoven fabrics, the invention offers the potential for an attractive variety of fabric properties, depending on the wide range of possible orientations of the constituent fibers in the fabric structure. It is well known in the art that strongly anisotropic fabrics result when the fabrics are carded, thereby producing webs leading individually to fabric properties very different in the machine and cross-machine directions. More isotropic fabrics result when layers of carded webs are laid up crosswise one upon the other before being bonded as discussed above, or when any of a number of well known dry or wet methods for random laydown of fiber blend webs are employed.

EXAMPLES

In the following non-limiting examples the invention is illustrated with fabrics made from carded batts. Measurements of recovery properties of the anisotropic fabrics were taken in the machine direction, as most illustrative of the merits of the invention. It should be understood that with the use of more isotropically laid-up fabric batts, less attention to the direction of measurement would be required.

Two fibers were employed in preparing the batts. One fiber was commercially available polyethylene terephthalate (PET), conventionally melt-spun, fully drawn, crimped, then cut to $1\frac{7}{8}$"staple. The other fiber was straight (i.e. uncrimped) polybutylene terephthalate (PBT) staple which had been melt-spun as partially oriented (POY) continuous filament, made into tow, fully stretched, and then cut to $1\frac{1}{2}$" staple. Selected for testing because of its availability, the POY polybutylene terephthalate fiber was not believed significantly different for comparative purposes from the FOY (fully oriented yarn) polythylene terephthalate fiber. Their POY versus FOY differences, as the fabrics were tested, lay only in the different order in which the two fibers had reached the fully drawn state.

Batts of various weights were made from 100% PET (control), 75/25 PET/PBT, and 50/50 PET/PBT by blending and aligning the fibers on a conventional sample card. The batts were then subjected to ultrasonic bonding, employing identical speeds and horn pressures, by the machine and method of U.S. Pat. No. 4,311,540, the anvil points having the rectangular shape and pattern shown in FIG. 4*a* of the patent. Bonding intervals were less than the staple length of the fibers but greater than the crimp length of the PET fibers. The resulting fabrics ranged in weight from less than 3 to more than 6 oz/yd$^2$.

Test strips one inch wide (length in machine direction) were cut from each of the fabrics, and the weight of each in oz/yd$^2$ was determined. Stretching of each sample was accomplished at a rate of 25% extension per minute in accordance with the following cycle: stretch from 0% to 5% elongation, return to 0%; stretch from 0% to 10% elongation, return to 0%; stretch from 0% to 20% elongation; return to 0%. The stretching cycle was effected without hesitation at any reversal point. Measurements were noted at each interval of elongation and after each return to the 0% elongation point. The results of each elongation were calculated as:

$$\%\text{ tensile form recovery} = \frac{\%\text{ elongation recovered}}{\%\text{ elongation}} \times 100$$

The results are shown in Table I, below. The Table I, sample Nos. 1–5 consisted of a fabric of 100% crimped PET; sample Nos. 6–10 consisted of a fabric of 75% crimped PET/25% straight PBT; and sample Nos. 11–15 consisted of a fabric of 50% crimped PET/50% straight PBT.

TABLE I

| Sample No. | Fabric Weight oz/yd$^2$ | Tensile Form Recovery from a Strain of 5% | 10% | 20% |
|---|---|---|---|---|
| 1 | 2.86 | 65 | 50 | 32 |
| 2 | 3.50 | 56 | 44 | 30 |
| 3 | 3.84 | 59 | 45 | 30 |
| 4 | 5.63 | 57 | 43 | 31 |
| 5 | 5.81 | 60 | 43 | 32 |
| Aver. | 4.33 | 59 | 45 | 31 |
| 6 | 3.49 | 60 | 50 | 35 |
| 7 | 3.65 | 60 | 50 | 35 |
| 8 | 5.10 | 62 | 50 | 38 |
| 9 | 5.35 | 64 | 49 | 37 |
| 10 | 6.72 | 62 | 53 | 38 |
| Aver. | 4.86 | 63 | 50 | 37 |
| 11 | 4.11 | 67 | 53 | 42 |
| 12 | 4.32 | 66 | 53 | 42 |
| 13 | 4.44 | 65 | 53 | 41 |
| 14 | 4.50 | 62 | 54 | 43 |
| 15 | 6.57 | 66 | 56 | 44 |
| Aver. | 4.79 | 65 | 54 | 42 |

The data do not indicate fabric weight to have had any significant effect on the tensile form recovery of any of the three fabrics tested. It is readily apparent, particularly when the results are compared in the form of the averaged results for three groups, that the latter two groups of samples according to the invention exhibited significantly higher tensile form recovery than did the control samples of the first group, which contained only crimped PET. The advantageous effects of the invention become the more apparent, the higher the amount of strain applied, up to 20% strain. Thus, according to the present invention, novel nonwoven fabrics can be produced which exhibit superior stretch/recovery characteristics.

While the present invention has been herein described in what is presently considered to be the most preferred embodiments thereof, those in the art may appreciate that many modifications may be made hereof, which modifications should be accorded the broadest scope of the appended claims so as to encompass all equivalent structures, materials and/or methods.

What I claim is:

1. A nonwoven textile structure which exhibits improved stretch/recovery characteristics, said structure comprising a blend of staple fibers having a predetermined minimum staple fiber length and including a first component of nonelastic crimped fibers having a predetermined crimp length and a second component of quasi-elastic fibers, said crimped and quasi-elastic fibers being bonded together at intervals less than said minimum staple fiber length but greater than said crimp length, said quasi-elastic fibers being substantially uncrimped.

2. A nonwoven textile structure as in claim 1 wherein said crimped fibers are selected from the group consisting of nylon, polypropylene and polyethylene terephthalate staple fibers.

3. A nonwoven textile structure as in claim 2 wherein said quasi-elastic fibers are selected from the group consisting of SEF modacrylic and polymethylene terephthalate staple fibers.

4. A nonwoven textile structure as in claim 1 wherein the crimp length is less than about 0.10 inches.

5. A nonwoven textile structure as in claim 1 wherein the crimp length is between about 0.05 inches and about 0.10 inches.

6. A nonwoven textile structure as in claim 1 wherein said second component comprises at least 30% of said blend.

7. A nonwoven textile structure as in claim 1 wherein said staple fiber length is at least 1 inch.

8. A nonwoven structure as in claim 1 wherein said staple fiber length is between about 1 inch and about $1\frac{7}{8}$ inches.

9. A nonwoven textile structure as in claim 1 wherein said staple fiber length is about $1\frac{1}{2}$ inches.

10. A method of producing a nonwoven textile structure having improved stretch recovery characteristics, said method comprising the steps of:

(a) blending a first component of staple nonelastic crimped fibers having a predetermined crimp length and a second component of staple substantially straight quasi-elastic fibers to form a nonwoven batt, the first and second components having a minimum predetermined staple fiber length; and (b) bonding the fibers of the first and second components comprising the batt formed according to step (a) at predetermined intervals less than said minimum staple fiber length and greater than said crimp length.

11. A method as in claim 10 wherein step (b) is practiced utilizing ultrasonic bonding means.

12. A method as in claim 10 wherein said first component fibers are at least one selected from the group consisting of nylon, polypropylene and polyethylene terephthalate staple fibers.

13. A method as in claim 12 wherein said second component fibers are at least one selected from the group consisting of SEF modacrylic and polymethylene terephthalate staple fibers.

14. A method as in claim 10 wherein said second component comprises at least 30% of said batt.

* * * * *

UNITED STATES PATENT AND TRADEMARK OFFICE

CERTIFICATE OF CORRECTION

PATENT NO. : 4,486,485

DATED : December 4, 1984

INVENTOR(S) : Arnold M. Sookne

It is certified that error appears in the above-identified patent and that said Letters Patent is hereby corrected as shown below:

Column 2, line 5, change "glycols of dibasic" to --glycols or dibasic--.

Signed and Sealed this

*Sixth* Day of *August 1985*

[SEAL]

*Attest:*

DONALD J. QUIGG

*Attesting Officer* *Acting Commissioner of Patents and Trademarks*